United States Patent [19]

Gartland, Jr.

[11] 3,945,710

[45] Mar. 23, 1976

[54] CONTACT SPRING

[75] Inventor: Albert J. Gartland, Jr., Trumbull, Conn.

[73] Assignee: Harvey Hubbell, Incorporated, Orange, Conn.

[22] Filed: Dec. 2, 1974

[21] Appl. No.: 528,879

Related U.S. Application Data

[62] Division of Ser. No. 283,790, Aug. 25, 1972, Pat. No. 3,867,008.

[52] U.S. Cl. ..... 339/258 R

[51] Int. Cl.[2] ..... H01R 13/12

[58] Field of Search ..... 339/47, 49, 74, 258–262

[56] References Cited

UNITED STATES PATENTS

| | | | |
|---|---|---|---|
| 2,243,741 | 5/1941 | Rowe | 339/259 F |
| 3,011,143 | 11/1961 | Dean | 339/258 P |

FOREIGN PATENTS OR APPLICATIONS

| | | | |
|---|---|---|---|
| 932,390 | 11/1947 | France | 339/193 N |

*Primary Examiner*—Joseph H. McGlynn

*Attorney, Agent, or Firm*—Wooster, Davis & Cifelli

[57] ABSTRACT

A double wiping female contact for engagement with straight male contacts of varying thickness, particularly where very high contact pressures must be developed between such contacts. Cooperatively configured spring members are disposed on the female contact to achieve a deflection bias which magnifies the contact pressure developed when the spring members are forced to separate by any distance. Contact pressures proportional to the magnitude of separation are attained beyond the elastic limit of the spring members by incorporating sufficient deflection bias to compensate for the permanent set incurred.

11 Claims, 8 Drawing Figures

CONTACT SPRING

This is a divisional application of my copending application Ser. No. 283,790 filed Aug. 25, 1972 and entitled, Contact Spring, now U.S. Pat. No. 3,867,008.

BACKGROUND OF THE INVENTION

The present invention relates to a double wiping female contact and especially to such a contact having spring members which amplify the deflections imposed to magnify the contact pressures developed. Hitherto, many different types of double wiping female contacts have been utilized to develop the high contact pressure necessary for retaining and electrically interfacing with male contacts. Most such contacts consist of a pair of opposing cantilever springs and it would appear that the contact pressures developed thereby could be increased by merely varying the length, width, or thickness of the spring members. However, variations in length are not practical because an increase in contact pressure requires a reduction in length which thereby affects the required length of the male contact. Variations in width are not practical because an increase in contact pressure requires an increase in width and where the female contact is adapted to receive male contacts of either a parallel or a tandem pair, the width of the spring members is limited in magnitude. Generally, this limitation is caused on one side by the center to center distance separating the male contacts of the parallel pair and on the other side by the overall dimensions of the connector body. The contact pressure increases as the thickness of the spring members increases which usually depends on the thickness of the material utilized to fabricate the female contact. Although the thickness of the spring members is relatively unlimited, increases in material thickness are not practical because they are accompanied by increased expense for both raw materials and fabrication. Also, the deflectable range of the spring members below their elastic limit decreases as the material thickness increases and therefore the thickness range of engaging male contacts is reduced.

In some instances the contact pressure has been increased through the use of materials having a very high modulus of elasticity. However, the electrical resistivity of many materials, such as copper, increases as the modulus of elasticity increases and therefore, the current carrying capacity of the contact is decreased by such an approach. Also, materials having a very high modulus of elasticity are usually more costly and more difficult to fabricate.

Various codes and specifications require that female contacts be capable of engagement by male contacts of varying thicknesses and that a specific contact pressure be exerted upon male contacts of minimum thickness after male contacts of maximum thickness have been engaged. These requirements can not be met by many female contacts because the spring members will be deflected beyond their elastic limit when the male contact of maximum thickness is inserted. Such deflections cause a permanent set in the spring members which reduces the contact pressure developed thereafter upon male contacts of minimum thickness.

SUMMARY OF THE INVENTION

It is therefore, a general object of the present invention to provide a double wiping female contact which minimizes and obviates the disadvantages of the prior art.

It is a specific object of the present invention to provide a double wiping female contact having spring members which attain amplified deflections to thereby magnify the contact pressure developed.

It is a more specific object of the present invention to provide a double wiping female contact having spring members which are disposed to compensate for the permanent set incurred on exceeding the elastic limit to thereby extend the proportional range of the contact pressure developed by the spring members.

These objects are accomplished in one form according to the present invention by configuring the opposing spring members of the female contact to cooperate in overlapping across the central plane along which the male contact engages. The contact surface on each spring member is disposed on the overlapping portion and is offset a distance from the central plane of engagement. On engagement, the deflection of the spring members is amplified by the magnitude of the offset distance and therefore the contact pressure developed thereby is magnified. Proportionality between the deflection and the contact pressure developed is extended in range beyond the elastic limit of the material utilized, by incorporating a sufficient offset distance to compensate for the permanent set thereby incurred.

BRIEF DESCRIPTION OF THE DRAWINGS

The manner in which these and other objects of the invention are achieved will be best understood by reference to the following description, the appended claims, and the attached drawings wherein:

DESCRIPTION OF THE PREFERRED EMBODIMENT

Figure 1:
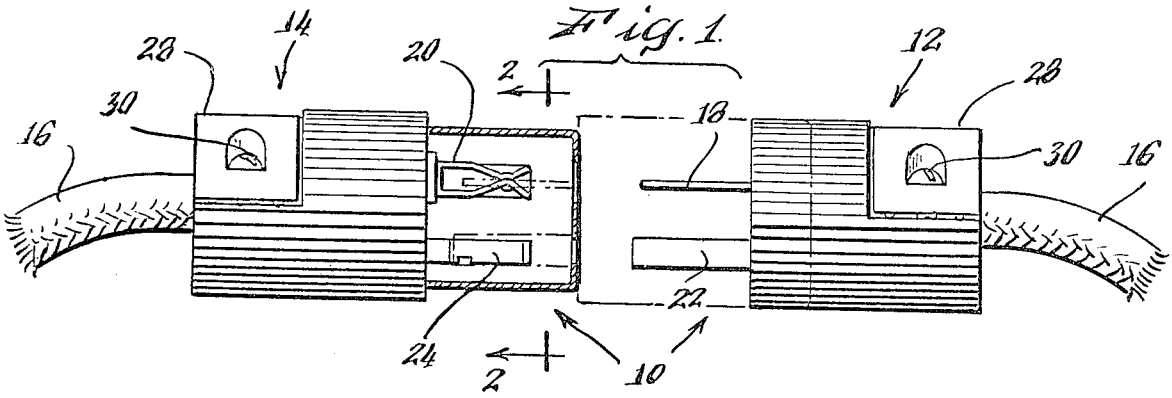
FIG. 1 is a side elevational view of an unengaged electrical connector with portions of the connector body cut away to illustrate the female contacts of this invention.
Figure 2:
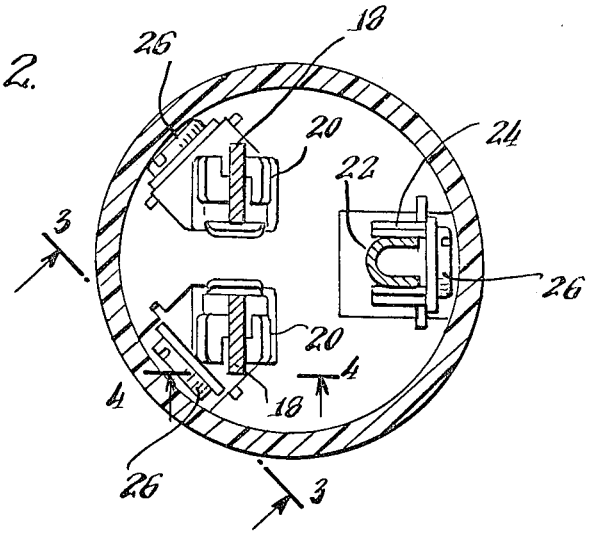
FIG. 2 is an enlarged sectional view of the engaged connector taken along lines 2—2 of FIG. 1 to illustrate the forced separation caused to the opposing spring members upon insertion of the male contacts.
Figure 3:
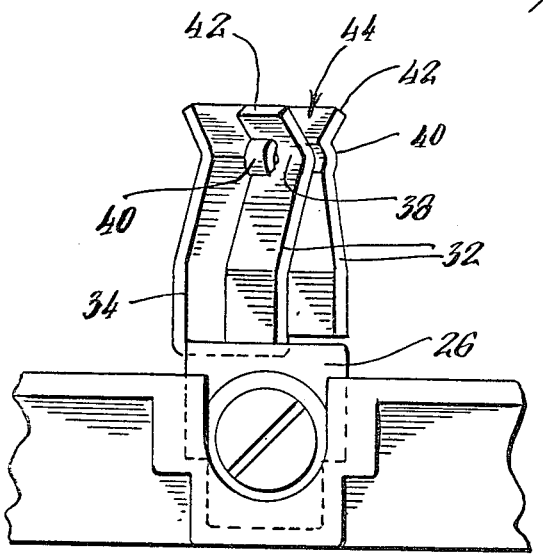
FIG. 3 is an enlarged partial elevational view thereof taken perpendicularly to plane 3—3 of FIG. 2 but with the male contacts withdrawn to illustrate the cooperative configuration existing between the opposing spring members.

Turning now to the drawings, and more particularly to FIG. 1, there is illustrated a cable connector 10 having a cap 12 and a connector body 14. An electrical cable 16 is connected separately to each of the cap 12 and the connector body 14. Straight male contacts 18 extend from the cap 12 and engage into double wiping female contacts 20 within the connector body 14, as shown by the phantom lines, to electrically interconnect the power conductors (not shown) of the cable 16. A male ground contact 22 also protrudes from the cap 12 for engagement into a female ground contact 24 within the connector body 14 to electrically interconnect the ground conductor (not shown) of the cable 16. All contacts 18, 20, 22, and 24 include suitable terminal means for connecting to the conductors, such as screw lugs 26 which are shown in FIGS. 2 and 3. The cable 16 is secured to both the cap 12 and the connector body 14 by a cable clamp 28 which is fastened thereto by any suitable means, such as screws 30.

Generally, the male contacts 18 and the male ground contact 22 are arranged on the cap 12 to designate specific electrical parameters, such as operating voltage or current levels. The character of each arrangement is determined by the relative orientation of the male contacts 18 which may be located in parallel, or in tandem, or in any combination resulting from the parallel and tandem locations. The female contact 20 is constructed to receive the male contacts 18 in either of two perpendicular directions. Within the connector body 14, a pair of female contacts 20 are arranged to receive the male contacts 18 of any relative orientation but may be limited to particular orientations through the use of slotted entrances in the connector body 14.

Figure 4:
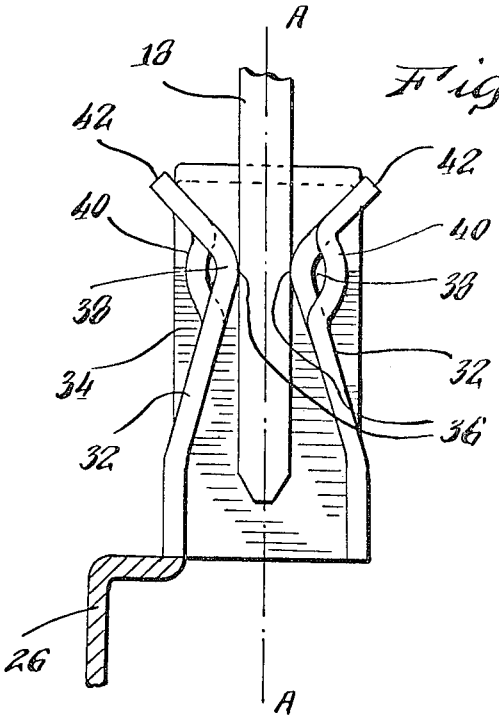
FIG. 4 is an enlarged partial elevational view thereof taken perpendicularly to plane 4—4 of FIG. 2 to illustrate the central plane along which the male contact engages between the opposing spring members.

As illustrated in FIGS. 2 and 4, male contacts 18 in tandem locations are received into the female contacts 20 between cooperating spring members 32 which separate in opposite directions to receive the male contacts 18 along a central plane of engagement A—A. Male contacts 18 in parallel locations are received between a third spring member 34 and the sides of the cooperating spring members 32, with the third spring member 34 deflecting as the male contact 18 enters therebetween. When male contacts 18 are arranged in a combination of parallel and tandem locations, one male contact 18 is received between the cooperating spring members 32 on one female contact 20 while the other male contact 18 is received between the third spring member 34 and the sides of the cooperating spring members 32 on the other female contact 20.

Of course, each female contact 20 could be arranged within the connector body 14 to receive male contacts 18 in parallel locations between the cooperating spring members 32, while receiving male contacts 18 in tandem locations between the third spring member 34 and the sides of the cooperating spring members 32. However, throughout this specification the previously described arrangement will be utilized. In this arrangement the cooperating spring members 32 are relatively more restricted in cross section than the third spring member 34 and therefore, to increase the contact pressure exerted by the cooperating spring members 32 against the male contacts 18 presents a greater problem. Because of this, the invention will be disclosed in regard to the cooperating spring members 32, however, no reason exists to preclude the application of this invention to the thrid spring member 34.

An electrical connection results between the male contact 18 and the female contact 20 when the male contact 18 is engaged between the cooperating spring members 32. Each spring member 32 includes a contact surface 36 which is forced to bear against the engaging male contact 18 and, as illustrated in FIG. 4, the contact surfaces 36 are separated across the thickness of the male contact 18 as a result of engagement. Therefore, the contact pressure exerted on the male contact 18 by the contact surfaces 36 is proportional to the combined deflection caused to the spring members 32 during engagement.

Figure 5:
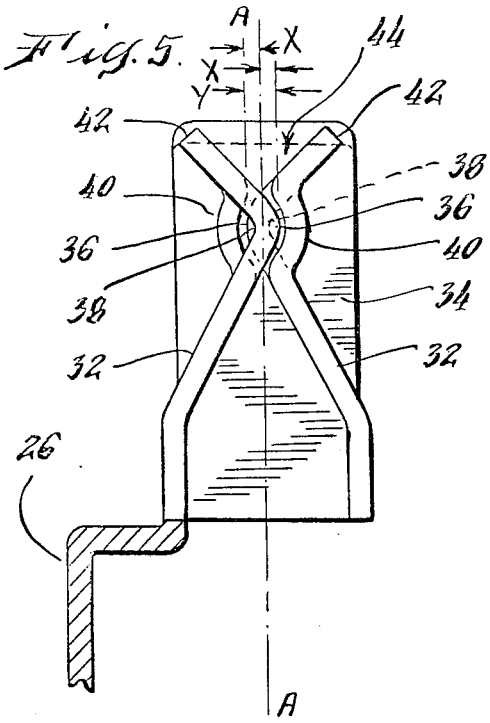
FIG. 5 is a view similar to that of FIG. 4 with the male contact disengaged to illustrate the overlap existing between the opposing spring members across the central plane of engagement.

The spring members 32 are specially constructed to magnify the contact pressure developed on engaging male contacts 18 by deflecting through a distance of greater magnitude than the thickness of the male contact 18. This special construction is illustrated in FIGS. 3–5 and consists essentially of a cooperative configuration between the opposing spring members 32 to permit the contact surfaces 36 to overlap across the central plane of engagement A—A. To achieve this cooperative configuration, the portion of each spring member 32 in closest proximity to the central plane of engagement A—A is segmented into bi-levels sections, an advanced section 38 and a retracted section 40, as illustrated in FIG. 3. The bi-level sections on opposing spring members 32 are arranged to mesh into each other across the central plane of engagement A—A, as illustrated in FIG. 5, with the advanced section 38 on each spring member 32 disposed into the retracted section 40 on the other spring member 32. The high point of each advanced section 38 is offset across the central plane of engagement A—A by a distance "X" and comprises the contact surface 36 on each spring member 32. The sum of the offset distances X at which both contact surfaces 36 are disposed is equal to an overall offset distance "Y". Each spring member 32 is configured to have an inclined tip 42 and the complementary orientation of the tips 42 creates a guided entrance 44 into the female contact 20 along the central plane of engagement A—A.

When the cap 12 is mated into the connector body 14, the male contacts 18 enter into the female contacts 20 along the central plane of engagement A—A, as illustrated in FIG. 4. Initially, the male contacts 18 enter the guided entrance 44 and come to bear against the inclined tip 42 of the spring members 32. Then a force is applied to move the male contacts 18 along the central plane of engagement A—A, which thereby causes the opposing spring members 32 to deflect in opposite directions and to carry the contact surfaces 36 across the central plane of engagement A—A. Only after the spring members 32 have been deflected through a combined distance equal to the thickness of the male contact 18 plus the overall offset distance Y, will the male contacts 18 move between the contact surfaces 36. Therefore, the deflection resulting in the spring members 32 is amplified beyond the thickness magnitude of the male contact 18. Since the contact pressure exerted against the male contact 18 by the contact surfaces 36 is proportional to the deflection of the spring members 32, the contact pressure is thereby magnified. furthermore, the contact pressure to be exerted on a male contact 18 of any particular thickness can be magnified to any desired magnitude by merely increasing the overall offset distance Y of the contact surfaces 36 from the central plane of engagement A—A.

Figure 6:
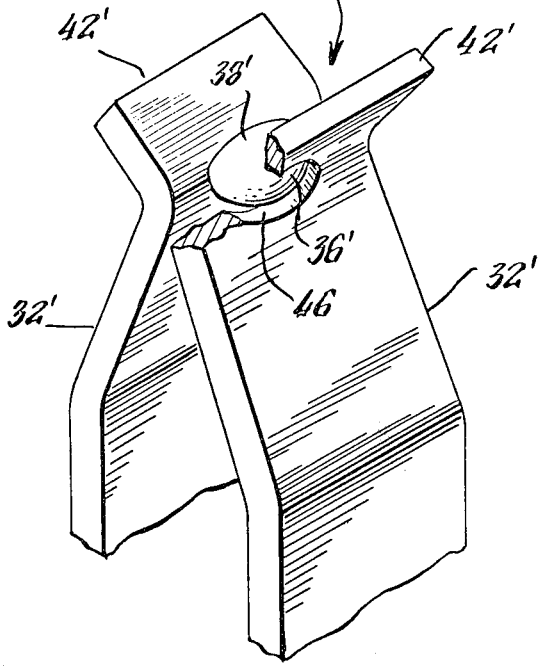
FIG. 6 is an enlarged perspective view of an alternately shaped female contact incorporating the features of this invention.
Figure 7:
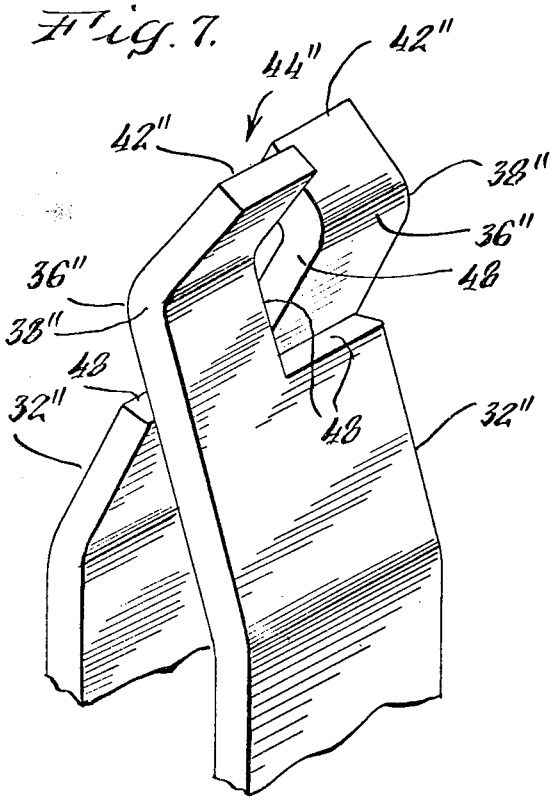
FIG. 7 is an enlarged perspective view of another female contact incorporating the features of this invention.
Figure 8:
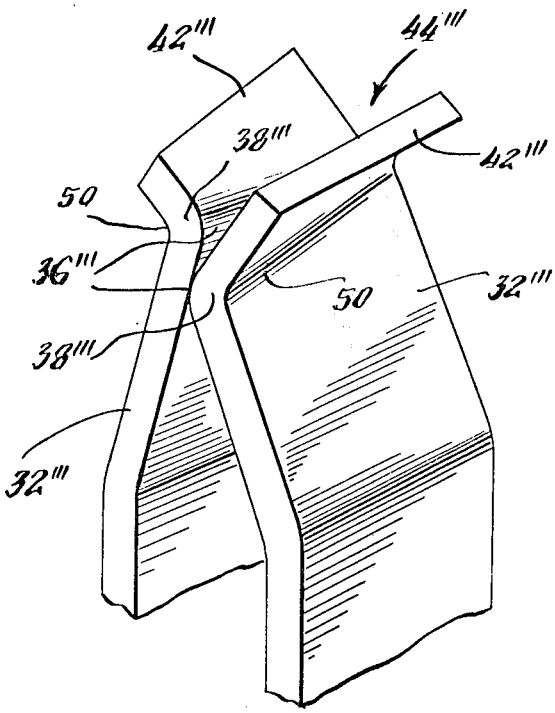
FIG. 8 is an enlarged perspective view of still another female contact incorporating the features of this invention.

As illustrated in FIGS. 6–8, I have devised several cooperative configurations by which an overlap of contact surfaces across the central plane of engagement is accomplished for female contacts having opposing spring members. Due to the similarities existing between the configuration shown in FIG. 5 and the configurations shown in FIGS. 6–8, similar parts in FIGS. 6–8 are identified by the same reference numerals as those used in FIG. 5 but with a prime (′) added thereto in FIG. 6, a double prime (″) added thereto in FIG. 7, and a triple prime (‴) added thereto in FIG. 8. Generally, the choice of cooperative configuration selected depends on both the nature of the application and the fabrication expense to be borne.

FIG. 6 illustrates a configuration by which an overall offset distance of nominal magnitude is achieved with a single spring member 32′ crossing the central plane of engagement. In this configuration a spherical advanced section 38′ is disposed on one spring member 32′ and an aperture 46 is disposed through the other spring member 32′. The aperture 46 is precisely located to allow the advanced section 38′ to pass across the central plane of engagement prior to deflection of the spring members 32′. A contact surface 36′ is disposed on the tip of the advanced section 38′ and therefore overlaps the contact surface 36′ located on the spring member 32′ through which the aperture 46 is disposed.

Where an overall offset distance of very large magnitude is necessary, the configuration illustrated in FIG. 7 is utilized. In this configuration, each spring member 32″ has an advanced section 38″ disposed immediately adjacent to an open notch 48 which is precisely located to allow the advanced section 38″ on the other spring member 32″ to pass across the central plane of engagement prior to deflection of the spring members 32″. A contact surface 36″ is disposed at the tip of each advanced section 38″ and therefore the contact surfaces 36″ are overlapping.

When fabrication expense is of primary concern, the configuration illustrated in FIG. 8 may be utilized. In this configuration, the advanced section 38‴ on each spring member 32‴ is established with an askewed bend 50. On each spring member 32‴ the askewed bend 50 is dislocated from and divergent relative to the askewed bend 50 on the other spring member 32‴ to allow the advanced sections 38‴ to overlap across the central plane of engagement prior to deflection of the spring members 32‴. A contact surface 36‴ is disposed at the tip of each advanced section 38‴ and therefore the contact surfaces 36‴ are overlapping across the central plane of engagement.

Female contacts having opposing spring members are commonly used in applications where engagement by male contacts in a wide range of thicknesses is anticipated. In such applications, the contact pressure exerted on the male contact of maximum thickness is of course much greater than that exerted on the male contact of minimum thickness. Where conventional female contacts are utilized, this differential in contact pressure presents a problem in that the contact pressure exerted on male contacts of minimum thickness is not sufficient to comply with recently published codes. To further complicate matters, the maximum contact pressure attainable with the spring members of conventional female contacts is limited by the elastic limit of the material from which the female contact is fabricated. This is so because upon exceeding the elastic limit, the spring members are work hardened and encounter a permanent set. Thereafter, the combined deflection achieved by the spring members for any male contact will be reduced by the total magnitude of permanent set encountered. Since the contact pressure is directly proportional to the combined deflection of the spring members, it is reduced in direct proportion to the magnitude of the permanent set.

The problems caused due to the differential in contact pressure may be overcome with the female contact 20 of this invention. First of all, the deflection of its spring members 32 can be amplified to magnify the contact pressure developed on the male contact 18 of minimum thickness. Then where the elastic limit of the material is exceeded on engagement of the male contact 18 of maximum thickness, the overall offset distance Y may be increased sufficiently to compensate for the anticipated permanent set. Since the spring contact of the spring members 32 will remain the same after exceeding the elastic limit but the zero deflection point thereof will be shifted due to the permanent set encountered, this compensation may be utilized to extend the range of contact pressure developed proportionally to deflection beyond the elastic limit of the material.

Those skilled in the art should readily appreciate that the female contact embodied by this invention includes spring members which attain amplified deflections and thereby magnify the contact pressure developed against the male contact. Furthermore, the spring members can be disposed to compensate for the permanent set incurred upon exceeding the elastic limit of the material which thereby extends the range of contact pressure developed proportionally to the deflection of the spring members.

It should be understood that the present disclosure has been made only by way of example and that numerous changes in details of construction and the combinations or arrangements of parts may be resorted to without departing from the true spirit and scope of the invention, and therefore, the present disclosure should be construed as illustrative rather than limiting.

What I claim is:

1. An electrical female contact comprising: a pair of spring members integrally connected and disposed to deflect in opposite directions away from a central plane as straight male contacts are engaged therebetween, said spring members having base ends of similar generally rectangular configuration and free ends, means fixedly mounting the base ends so as to be in substantially parallel, spaced-apart relationship with said base ends mutually opposed substantially symmetrically with respect to said central plane and substantially coincident throughout their configurations, each said spring member having a contact surface and an outwardly inclined tip, portions of said spring members between said outwardly inclined tips and said base ends being inclined inwardly toward said central plane, said contact surfaces on said opposite spring members being separated across the thickness of engaging male contacts and bearing thereagainst with a contact pressure of proportional magnitude to the deflection incurred by said spring members, said inclined tips being complementarily oriented to create a guided entrance across the full width of male contact engagement along said central plane, at least one of said spring members having an advanced section disposed thereon and aligned to pass through said opposite spring member across said central plane prior to deflection of said spring members, said advanced section having a contact surface disposed thereon at an offset distance from said central plane, said offset contact surface moving through said offset distance across said central plane during engagement of said female contact by male contacts, the contact pressure on said contact surfaces of said opposite spring members being proportional to the total deflection of said advanced section with that total deflection being equal to said offset distance plus the thickness of the male contact.

2. The female contact of claim 1 wherein said advanced section is of spherical configuration and an aperture is disposed through said opposite spring member, said advanced section passing through said aperture prior to deflection of said spring members.

3. The female contact of claim 2 wherein said spring members are deflected beyond the elastic limit of their material, said offset distance being reduced in magnitude by the permanent set resulting therefrom with the contact pressure on said contact surfaces thereafter being proportional to deflection beyond the elastic limit of said opposite spring members.

4. The female contact of claim 1 wherein said spring members are deflected beyond the elastic limit of their material, said offset distance being reduced in magnitude by the permanent set resulting therefrom with the contact pressure on said contact surfaces thereafter being proportional to deflection beyond the elastic limit of said opposite spring members.

5. The female contact of claim 4 wherein each said spring member includes an advanced section having a contact surface disposed thereon and aligned to pass through said opposite spring member across said central plane prior to deflection of said spring members, each said advanced section having a contact surface disposed thereon at an offset distance from said central plane, each said contact surface moving through said offset distance across said central plane during engagement of said female contact by male contacts, the contact pressure on said contact surfaces being proportional to the total deflection of said advanced sections on said opposite spring members with that total deflection being equal to the sum of said offset distances plus twice the thickness of the male contact.

6. The female contact of claim 5 wherein said contact surfaces on said opposite spring members are disposed at equal offset distances from said central plane, the total deflection being equal to twice the sum of said offset distance plus the thickness of the male contact.

7. The female contact of claim 5 wherein an open notch is disposed immediately adjacent to each said advanced section on said spring members, said advanced section of each said spring member meshing across said central plane into said open notch of said opposite spring member.

8. An electrical female contact comprising: a pair of spring members integrally connected and disposed to deflect in opposite directions away from a central plane as straight male contacts are engaged therebetween, said spring members having base ends of similar generally rectangular configuration and free ends, means fixedly mounting the base ends so as to be in substantially parallel, spaced-apart relationship with said base ends mutually opposed substantially symmetrically with respect to said central plane and substantially coincident throughout their configurations, each said spring member having a contact surface and an outwardly inclined tip, portions of said spring members between said outwardly inclined tips and said base ends being inclined inwardly toward said central plane, said contact surfaces on said opposite spring members being separated across the thickness of engaging male contacts and bearing thereagainst with a contact pressure of proportional magnitude to the deflection incurred by said spring members, said inclined tips being complementarily oriented to create a guided entrance across the full width of male contact engagement along said central plane, an advanced section of spherical configuration being disposed on at least one of said spring members and an aperture being disposed through said opposite spring member across said central plane, said advanced section being aligned to pass through said aperture and having a contact surface disposed thereon at an offset distance from said central plane prior to deflection of said spring members, said offset contact surface moving through said offset distance across said central plane during engagement of said female contact by male contacts, the contact pressure on said contact surfaces of said opposite spring members being proportional to the total deflection of said advanced section with that total deflection being equal to said offset distance plus the thickness of the male contact.

9. The female contact of claim 8 wherein said spring members are deflected beyond the elastic limit of their material, said offset distance being reduced in magnitude by the permanent set resulting therefrom with the contact pressure on said contact surfaces thereafter being proportional to deflection beyond the elastic limit of said opposite spring members.

10. An electrical female contact comprising: a pair of spring members integrally connected and disposed to deflect in opposite directions away from a central plane as straight male contacts are engaged therebetween, said spring members having base ends of similar generally rectangular configuration and free ends, means fixedly mounting the base ends so as to be in substantially parallel, spaced-apart relationship with said base ends mutually opposed substantially symmetrically with respect to said central plane and substantially coincident throughout their configurations, each said spring member having a contact surface and an outwardly inclined tip, portions of said spring members between said outwardly inclined tips and said base ends being inclined inwardly toward said central plane, said contact surfaces on said opposite spring members being separated across the thickness of engaging male contacts and bearing thereagainst with a contact pressure of proportional magnitude to the deflection incurred by said spring members, said inclined tips being complementarily oriented to create a guided entrance across the full width of male contact engagement along said central plane, each said spring member having an advanced section immediately adjacent to an open notch, each said advanced section being aligned to pass through said open notch in said opposite spring member across said central plane and having a contact surface disposed thereon at an offset distance from said central plane prior to deflection of said spring members, said contact surfaces moving through said offset distances across said central plane during engagement of said female contact by male contacts, the contact pressure on said contact surfaces being proportional to the total deflection of said advanced sections on said opposite spring members with that total deflection being equal to the sum of said offset distances plus twice the thickness of the male contact, said spring members being deflected beyond the elastic limit of their material, said offset distances being reduced in magnitude by the permanent set resulting therefrom with the contact pressure on said contact surfaces thereafter being proportional to deflection beyond the elastic limit of said opposite spring members.

11. The female contact of claim 10 wherein said contact surfaces on said opposite spring members are disposed at equal offset distances from said central plane, the total deflection being equal to twice the sum of said offset distance plus the thickness of the male contact.

* * * * *